US005758605A

United States Patent [19]

Calkins

[11] Patent Number: 5,758,605

[45] Date of Patent: Jun. 2, 1998

[54] STEAM GENERATOR

[76] Inventor: Noel C. Calkins, 515 Seward Park Ave., Albuquerque, N. Mex. 87123

[21] Appl. No.: 544,271

[22] Filed: Oct. 17, 1995

[51] Int. Cl.[6] ..... F22B 1/02; F23J 7/00

[52] U.S. Cl. ..... 122/31.1; 431/4; 431/353

[58] Field of Search ..... 122/40, 31.1, 31.2, 122/5.52, 55, 78, 461; 432/159, 187; 126/344, 350 R, 351, 360 A, 380; 431/4, 353, 354, 157, 158

[56] References Cited

U.S. PATENT DOCUMENTS

| | | | |
|---|---|---|---|
| 3,162,236 | 12/1964 | Williams | 431/4 |
| 3,299,937 | 1/1967 | Cook | 122/40 |
| 3,730,673 | 5/1973 | Straitz | 431/278 |
| 3,980,137 | 9/1976 | Gray | 166/303 |
| 4,074,708 | 2/1978 | Hochmuth | 126/360 A |
| 4,474,140 | 10/1984 | Sternfeld et al. | 122/31.1 |
| 4,570,612 | 2/1986 | Ripka et al. | 126/360 A |
| 4,604,988 | 8/1986 | Rao | 126/360 A |
| 4,648,835 | 3/1987 | Eisenhawer et al. | 431/4 |
| 4,706,611 | 11/1987 | Nelson | 122/5.52 |
| 4,726,759 | 2/1988 | Wegener | 431/4 |
| 4,850,070 | 7/1989 | Safarik | 8/158 |
| 5,088,450 | 2/1992 | Sternfeld et al. | 122/31.1 |
| 5,163,830 | 11/1992 | Pfefferkorn | 431/354 |

*Primary Examiner*—William Doerrler
*Attorney, Agent, or Firm*—Richard J. Cordovano

[57] ABSTRACT

Method and apparatus for generating steam in which water is fed directly into a combustion zone which is configured in such a manner that water cannot by-pass the zone. A steam generator may be comprised of three conduits arranged coaxially with one another which carry fuel, oxygen, and feed water to a fuel-oxygen mixing zone and a combustion zone. Alternatively, a generator may be comprised of two concentric conduits which carry water and a mixture comprised of fuel and oxygen to a combustion zone. Steam flows out of the generator through a restriction at one end of the outermost conduit. In one embodiment, the combustion zone extends into a housing which communicates with and is attached to the outermost conduit. The invention provides very high thermal efficiency and very low atmospheric emissions.

20 Claims, 4 Drawing Sheets

STEAM GENERATOR

BACKGROUND OF THE INVENTION

This invention relates to the generation of steam and, more particularly, to steam generation utilizing direct contact between a heat source and water.

Steam is used in a myriad of applications and would be used in many more if a better method of producing it were available. Currently used steam generation apparatus is expensive and bulky. The high cost and large size of boilers, or steam generators, is due in part to use of heat transfer surfaces separating the source of heat from the water which must be heated and vaporized. Elimination of heat transfer surfaces, such as finned tubes, will increase heat transfer efficiency in addition to reducing cost and bulk. In the present invention, water is provided directly to the heat source; the heat does not pass through a metal barrier. Also, the present invention does not use a water reservoir to which a flame is applied, further reducing heat loss, cost and bulk. In addition the invention eliminates problems of nucleate boiling and stagnation, that is, existence of areas within a system where there is little flow of heat, water, and steam.

Safety is a major consideration in generation of steam. Catastrophic rupture of steam pressure vessels has caused much loss of life and property. Constructing and maintaining safe steam generation apparatus is costly. Steam boilers which produce steam at 15 psig and above, which includes virtually all boilers except household heating boilers, must be operated by licensed boiler technicians. A steam generator of the present invention enchances safety because it does not have large surfaces which are subjected to steam pressure. It is comprised of small tubular structures which may be inexpensively fabricated with thick walls.

There are many advantages to the use of steam in vehicle propulsion. Despite these advantages, steam is not currently used for this purpose, due to safety concerns, high cost of the generation apparatus, and size and weight of the apparatus. A steam generator of the present invention solves these problems. Another major advantage of this invention is that objectionable emissions are expected to be virtually nonexistent. The contribution to atmospheric pollution of internal combustion engines in vehicles is significant. Herculean efforts have been made to reduce vehicle emissions and huge sums of money are still being spent to design low emission propulsion systems. The products of the present invention will be water, nitrogen, and carbon dioxide and only small amounts of carbon monoxide, hydrocarbons, and nitrogen oxides will be emitted. In order to power a vehicle, the steam may be applied to steam turbines, to reciprocating steam engines comprised of one or more cylinders and pistons, or to other types of expanders.

The invention will be useful for pressurization of oil and gas wells to enhance recovery. The steam generator may be placed down the well to generate steam at the point where it is needed. Such down-hole pressurization will avoid cooling of steam as it flows thousands of feet down a well.

There are numerous other uses for the compact and inexpensive steam generators of this invention, including food processing, electrical power generation, other stationary power applications, process and building heating, and agricultural applications such as plowing and destroying weeds. Most processes which require heat can utilize heat provided by steam. This invention provides a route to greater use of steam, since it can now be generated less expensively and in less space, as compared the prior art.

SUMMARY OF THE INVENTION

This invention is a method and apparatus for generating steam in which water is fed directly into a combustion zone which is configured in such a manner that it is difficult for the water to by-pass the zone. A steam generator may be comprised of three conduits arranged coaxially with one another which carry fuel, oxygen, and feed water to a fuel-oxygen mixing zone and a combustion zone. Alternatively, a generator may be comprised of two concentric conduits which carry water and a mixture comprised of fuel and oxygen to a combustion zone. Steam flows out of a generator through a restriction at one end of the outermost conduit. In one embodiment, the combustion zone extends into a housing which communicates with and is attached to the outermost conduit. The invention provides very high thermal efficiency and very low atmospheric emissions.

An object of this invention is to provide a steam generator which is more compact in size than prior generators having the same steam capacity.

Another object is to provide a method of generating steam which produces relatively small amounts or none of the atmospheric pollutants carbon monoxide, nitrogen oxides and hydrocarbons.

A further object of this invention is to provide a steam generator which may be inexpensively constructed with thick walls, thus providing a high degree of safety in regard to a steam explosion.

Another object is to provide a generator which is capable of responding quickly to changes in steam demand, or load.

Another object is to provide a generator which can be fabricated and maintained at relatively low cost.

A further object is to provide a method of generating steam having a high thermal efficiency.

In one embodiment, the present invention is a method of generating steam comprising mixing fuel and oxygen in a mixing zone to form a mixture and flowing said mixture into a combustion zone; combusting the mixture in said combustion zone to form a heat source; flowing water into the combustion zone and limiting water flow rate to a value less than that which will quench combustion of the mixture; controlling the quantity of mixture flowing into the combustion zone at a value which is required to produce at least sufficient heat to vaporize substantially all water flowing into the combustion zone; and configuring the combustion zone so that substantially all water flowing into it is exposed to said heat source for a time sufficient for vaporization of the water to take place.

In another embodiment, the present invention is apparatus for generation of steam comprised of a feed tube having a fluid entry port at a first end and having a second end; a feed conduit having a fluid entry port at a first end and having a diameter greater than the diameter of said feed tube, where said feed conduit is disposed concentrically with the feed tube to form an annular feed space; a mixing zone weir having an inlet port and having an inlet end attached to and communicating with a second end of the feed conduit; a mixing zone located within the feed conduit which communicates with the feed tube at a second end of the feed tube, with said annular feed space, and with said mixing zone weir inlet port; a water conduit having a water entry port at a first end and having a diameter greater than the diameter of the feed conduit, where said water conduit is disposed concentrically with the feed conduit to form an annular water space; a combustion zone weir having an inlet end attached to and communicating with a second end of the water conduit; a combustion zone which is comprised of space between the mixing zone weir and said combustion zone weir, where said combustion zone is in communication with said mixing zone; a water distribution zone which communicates with said annular water space and is bounded by the mixing zone weir, the combustion zone weir, the water conduit, and the combustion zone, such that water which flows into said water distribution zone from said annular water space flows into the combustion zone; and ignition means for establishing combustion in the combustion zone.

In still another embodiment, the invention is apparatus for generation of steam comprised of a mixture feed conduit having a fluid entry port at a first end, a mixture weir having an inlet end attached to and communicating with a second end of said mixture feed conduit; a water feed conduit having a water entry port at a first end and having a diameter greater than the diameter of the mixture feed conduit, where said water conduit is disposed concentrically with the mixture feed conduit to form an annular water space, a combustion zone weir having an inlet end attached to and communicating with a second end of the water conduit; a combustion zone which is comprised of space between the mixture weir and said combustion zone weir, where said combustion zone is in communication with said mixture feed conduit; a water distribution zone which communicates with said annular water space and is bounded by the mixture zone weir, the combustion zone weir, the water conduit, and the combustion zone, such that water which flows into said water distribution zone from said annular water space flows into the combustion zone; and ignition means for establishing combustion in the combustion zone.

DETAILED DESCRIPTION OF THE INVENTION

Figure 1:
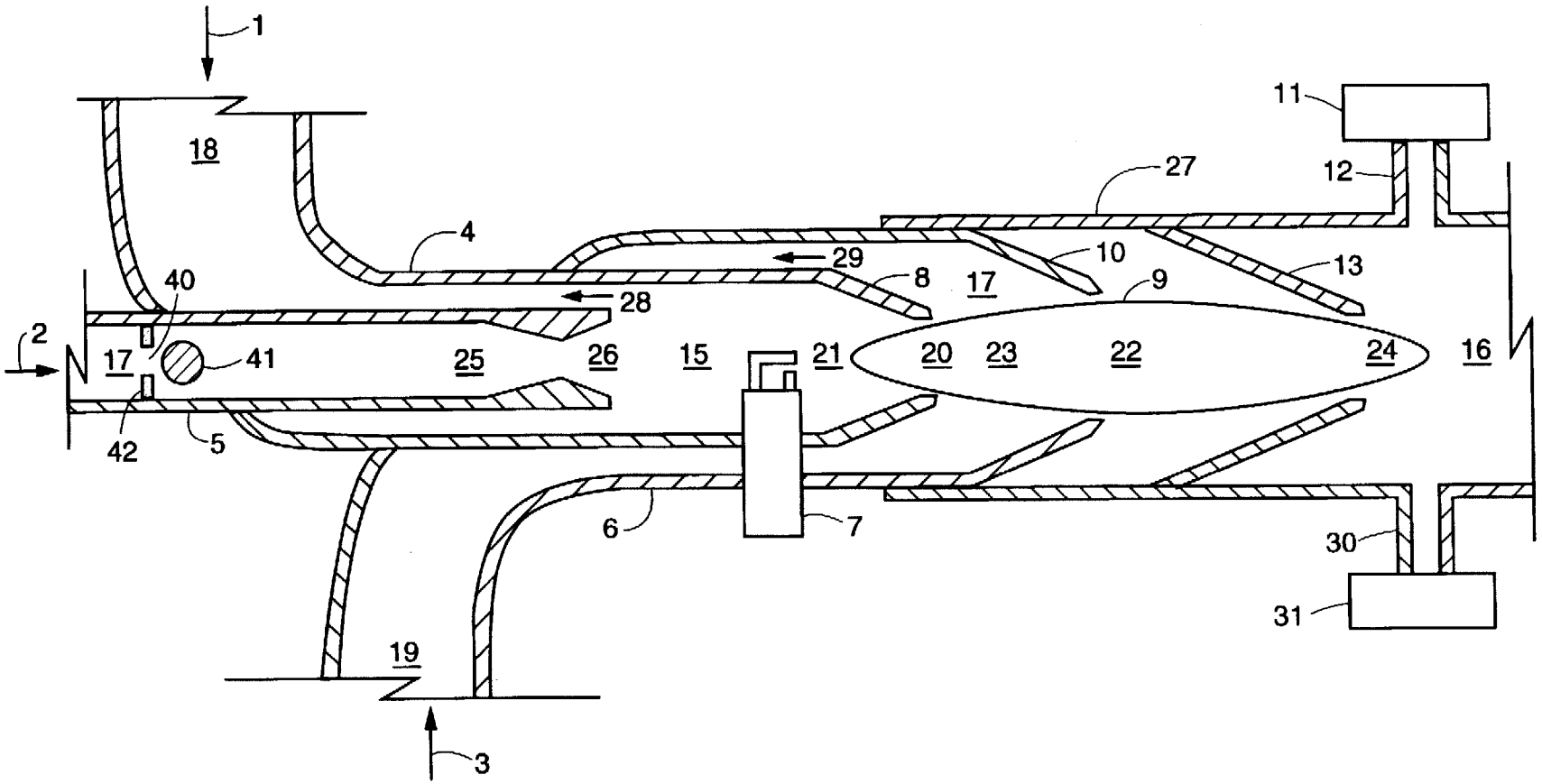
FIG. 1 depicts an embodiment of the invention in vertical section in a schematic manner. It is not to scale.

Referring now to FIG. 1, a feed stream enters feed tube 5 through fluid entry port 17, as depicted by arrow 2. Venturi 14 is attached to an end of feed tube 5 so that fluid from feed tube 5 flows into the inlet end of venturi 14 through venturi inlet port 25. Another feed stream enters feed conduit 4 through fluid entry port 18, as depicted by arrow 1. Fluid conduit 4 is disposed concentrically with feed tube 5 such that annular feed space 28 is formed between the outside wall of the feed tube and the inside wall of the feed conduit. Feed conduit 4 has a bend or elbow with an opening through which passes feed tube 5. In a similar manner, feed conduit 4 passes into water conduit 6 through an opening in a bend or elbow portion of the water conduit. A water stream enters water conduit 6 through water entry port 19, as depicted by arrow 3.

The inlet end of mixing zone weir 8 is attached to an end of feed conduit 4 such that fluid flowing in the feed conduit passes through inlet port 21 of mixing zone weir 8. In a similar manner, combustion zone weir 10 is attached to an end of water conduit 6. Secondary weir housing 27 is disposed concentrically with and attached to water conduit 6 and has secondary weir 13 disposed within it. Secondary weir 13 is concentric with combustion weir 10 and downstream of it.

Fuel, such as propane, flows through feed tube 5 and venturi 14 into mixing zone 15. Combustion air flowing in feed conduit 4 passes through annular feed space 28 and enters mixing zone 15. A zone of low pressure is created about outlet port 26 of the venturi by means of the fuel flowing through the converging and diverging sections of the venturi. This low pressure zone induces air flow into the mixing zone and promotes mixing of air and fuel. The air/fuel mixture flows from the mixing zone into combustion zone 23 and is ignited by spark igniter 7. Combustion zone 23 occupies a space between mixing zone weir 8 and combustion zone weir 10 and extends through outlet port 22 of the combustion zone weir. The combustion zone may extend through outlet port 20 of the mixing zone weir, as depicted in FIG. 1. The boundary of the combustion zone is depicted as indicated by reference number 9. However, as stated below, depiction of such boundary is not intended to limit the location of the combustion zone.

Water distribution zone 17 is defined by combustion zone weir 10, mixing zone weir 8, a portion of the interior wall of water conduit 6, and combustion zone 23. Water entering the water conduit through water entry port 19 flows through annular water space 29 and into water distribution zone 17. The steam generator is configured in such a manner that water introduced into the water conduit must flow into the combustion zone, where it is vaporized into steam.

It may be desirable to provide means for preventing backflow of fluids, for example, flow of fuel into the air supply conduit. This may be accomplished by means such as sensors, controllers, and final control elements or check valves. For example, in FIG. 1, ball check means comprised of plate 42 containing orifice 40 and ball 41 is shown in feed tube 55. In the event of backflow, or flow reversal, ball 41 will seat on plate 42, thereby stopping flow. Means for retaining ball 41 is not shown.

In FIG. 1, combustion zone 23 is depicted as extending through outlet port 24 of secondary weir 13. Additional secondary weirs (not shown) disposed in a similar manner to secondary weir 13 may be added to the secondary weir housing. The purposes of one or more secondary weirs include inducing turbulence in the combustion zone in order to promote vaporization. Secondary weirs may be used to ensure that no liquid water escapes into steam chamber 16 and to provide additional combustion zone volume. The combustion zone weirs and secondary weirs confine or restrict the flames to the space where mixing of heat and water take place. Use of a number of weirs facilitates operation at variable firing rates. Incondensable gases and steam pass into steam chamber 16. Means for venting incondensable gases is depicted by reference number 11 and connected to the steam chamber by conduit 12. Means for removing liquid water which accumulates in the steam chamber is depicted by reference number 31 and connected to the steam chamber by conduit 30. Design and location of means for venting gases and draining water must be accomplished upon reference to the specific application of the steam generator and the configuration of the steam chamber. Such means are well-known to those skilled in the art.

Figure 2:
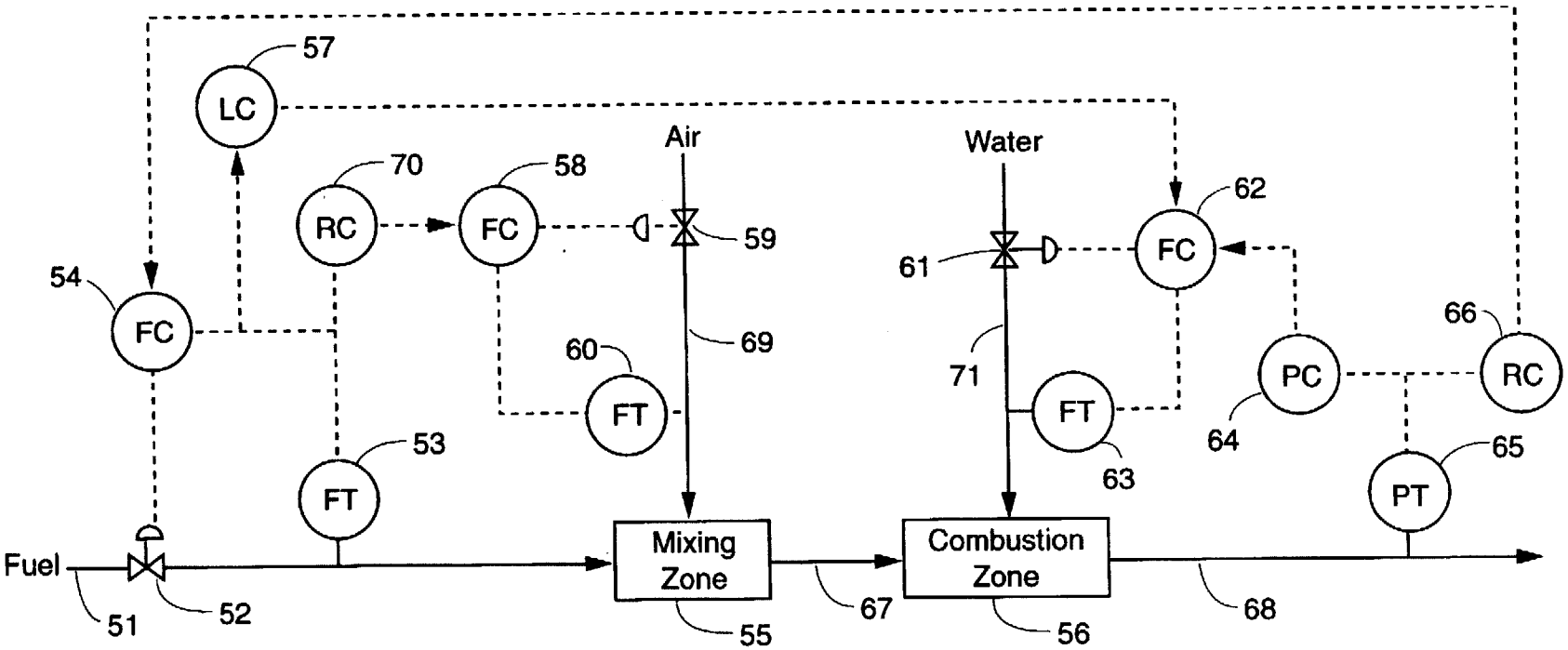
FIG. 2 depicts a control system, in a functional manner, which may be used in practicing the present invention.

The control system shown in FIG. 2 may be used in generating steam in the apparatus of this invention. The components shown may be conventional single purpose instruments, such as proportional band/reset/rate controllers, or they may be considered to depict functions which may be implemented with more sophisticated equipment, such as a computer which is programmed to monitor process condition input signals and execute appropriate control algorithms. There are numerous control schemes known to those skilled in the art which may be used. The final control elements used will depend on the nature of the feed streams and the purpose for which the steam generator is used. For example, the function of control valve 59 may be performed by a simple damper, operated manually, or by an actuator linked to a controller, or may be accomplished by system design, in that a venturi may be used to induce air flow to the combustion zone. The dashed lines of FIG. 2 represent control signals.

Fuel and air are supplied to mixing zone 55 by means of conduits 51 (fuel) and 69 (air). Flow transmitter 53 provides a control signal representative of fuel flow to fuel flow controller 54, which adjusts fuel control valve 52 in order to vary fuel flow rate. In a similar manner, air flow rate is transmitted by flow transmitter 60 to air flow controller 58, which varies air flow rate by varying the position of air control valve 59. A signal representing fuel flow rate is also provided to air/fuel ratio controller 70, which adjusts the set-point of air flow controller 58 so that a desired air/fuel quantity ratio is maintained.

Line 67 depicts the flow of air/fuel mixture into combustion zone 56. Water is supplied to the combustion zone by means of conduit 71. Water flow rate is adjusted by water control valve 61 in response to a control signal supplied by flow controller 62, which receives a water flow rate signal from water flow transmitter 63. The pressure of steam leaving the combustion zone in conduit 68 is provided to steam pressure controller 64 by pressure transmitter 65. Steam pressure controller 64 provides a control signal which adjusts the set-point of water flow controller 62 in order to increase or decrease water flow to the combustion zone in order to maintain a pre-determined steam pressure in conduit 68. A steam pressure signal is supplied to ratio controller 66, which generates a signal which adjusts the set-point of fuel flow controller 54. In this manner, sufficient fuel is supplied to vaporize the water supplied to the combustion zone. The rate of flow of fuel is supplied to limit controller 57, which provides a control signal to water flow controller 62 for the purpose of limiting water flow rate to a value less than a flow rate which would stop, or quench, combustion of the mixture in the combustion chamber.

It is a key feature of the invention that water to be vaporized is brought to the flame as it is needed to satisfy the demand for steam. A reservoir of water to which heat is added is not required. This permits steam output to be increased rapidly by increasing flow of water, fuel, and air. It is expected that full output of a generator will be obtained less than one minute after a cold start, that is, after flow of fuel, air, and water are started. Another key feature of the invention is the configuration of the apparatus such that water must pass through the combustion zone in order to exit from it. Still another key feature is the restriction at about the downstream end of the combustion zone which confines the flame and steam.

Figure 3:
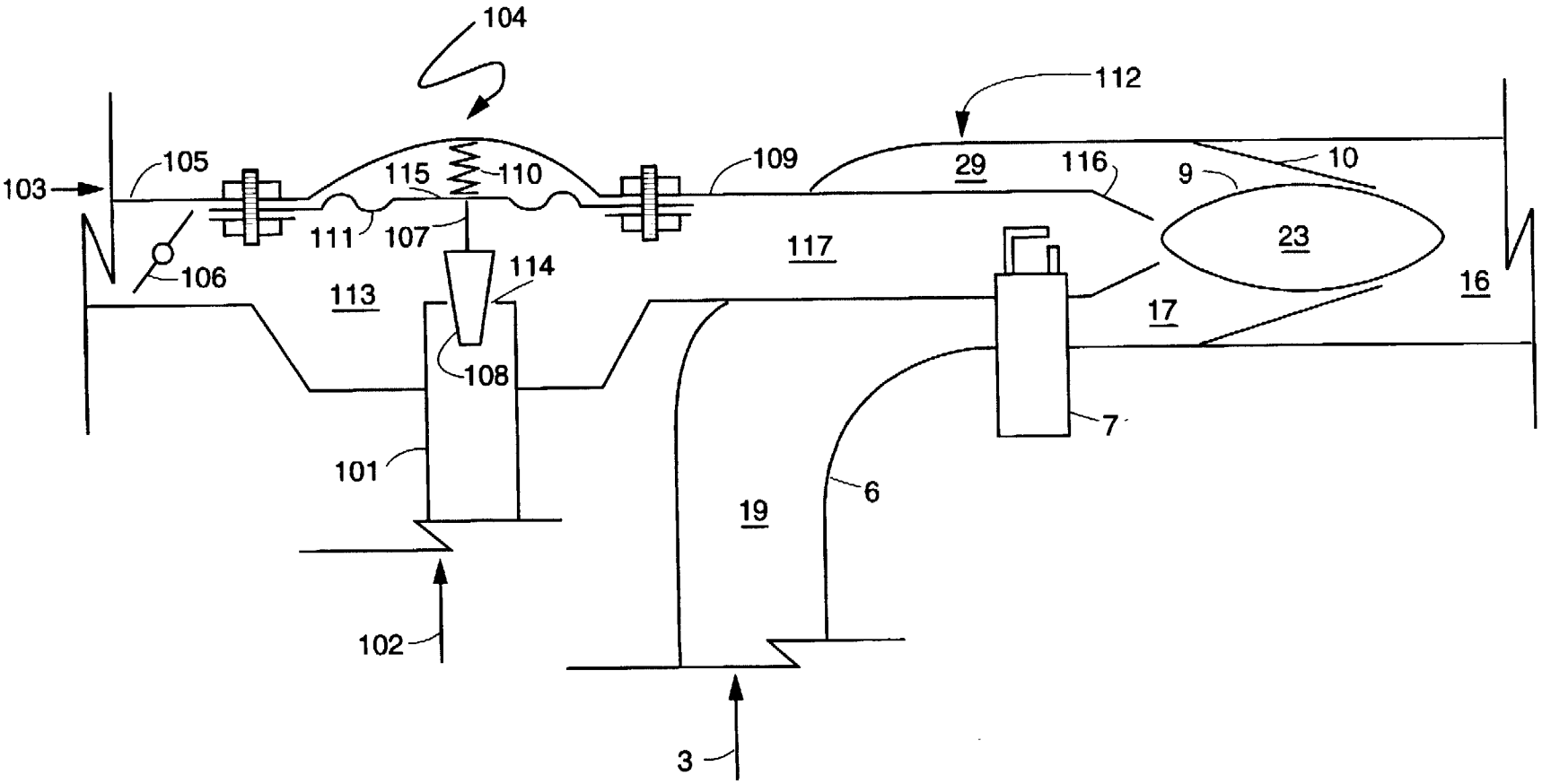
FIG. 3 schematically depicts a dry gas mixer and a steam generator which receives a fuel/air mixture from the dry gas mixer.

FIG. 3 depicts a steam generator 112 in which gaseous fuel and air are mixed in dry gas mixer 104 and supplied to fluid entry port 117 of mixture feed conduit 109. Air enters conduit 105 as shown by arrow 103 and flows into mixing chamber, or zone, 113. The amount of air which flows into chamber 113 is adjusted by air throttle 106. The position of air throttle 106 is varied to provide the desired flow by an actuator (not shown) external to conduit 105. Fuel enters conduit 101 as shown by arrow 102 and flows through metering orifice 114 into mixing chamber 113. Needle plug 108 is attached to diaphragm plate 115 by linking rod 107. Means for restraining linking rod 107 such that it moves only in a vertical direction is not shown. Diaphragm plate 115 is attached to flexible diaphragm 111 and spring 110 is disposed between plate 115 and the top of chamber 113. As the pressure of the air flowing into chamber 113 is varied by means of air throttle 106, the position of diaphragm 111 is changed by air pressure and spring 110, thus moving needle plug 108 in a vertical direction so that the quantity of fuel flowing through orifice 114 is varied. In this manner, the previously established fuel/air mixture ratio is maintained by adjusting only the position of air throttle 106. The fuel/air ratio may be established by methods known to those skilled in the art, such as providing a biasing screw to increase or decrease tension of spring 110, adjusting the configuration of needle plug 108, or adjusting the size of metering orifice 114. Other apparatus for mixing fuel and air is known to those skilled in the art. For example, fuel flow and air flow may be controlled in a manner similar to that shown in FIG. 2. The fuel/air mixture passes from mixture feed conduit 109 into combustion zone 23. Mixture weir 116 functions in the same manner as mixing zone weir 8 of FIG. 1. Other reference numbers of FIG. 3 are the same as those of FIG. 1 and the descriptions of FIG. 1 apply.

Figure 4:
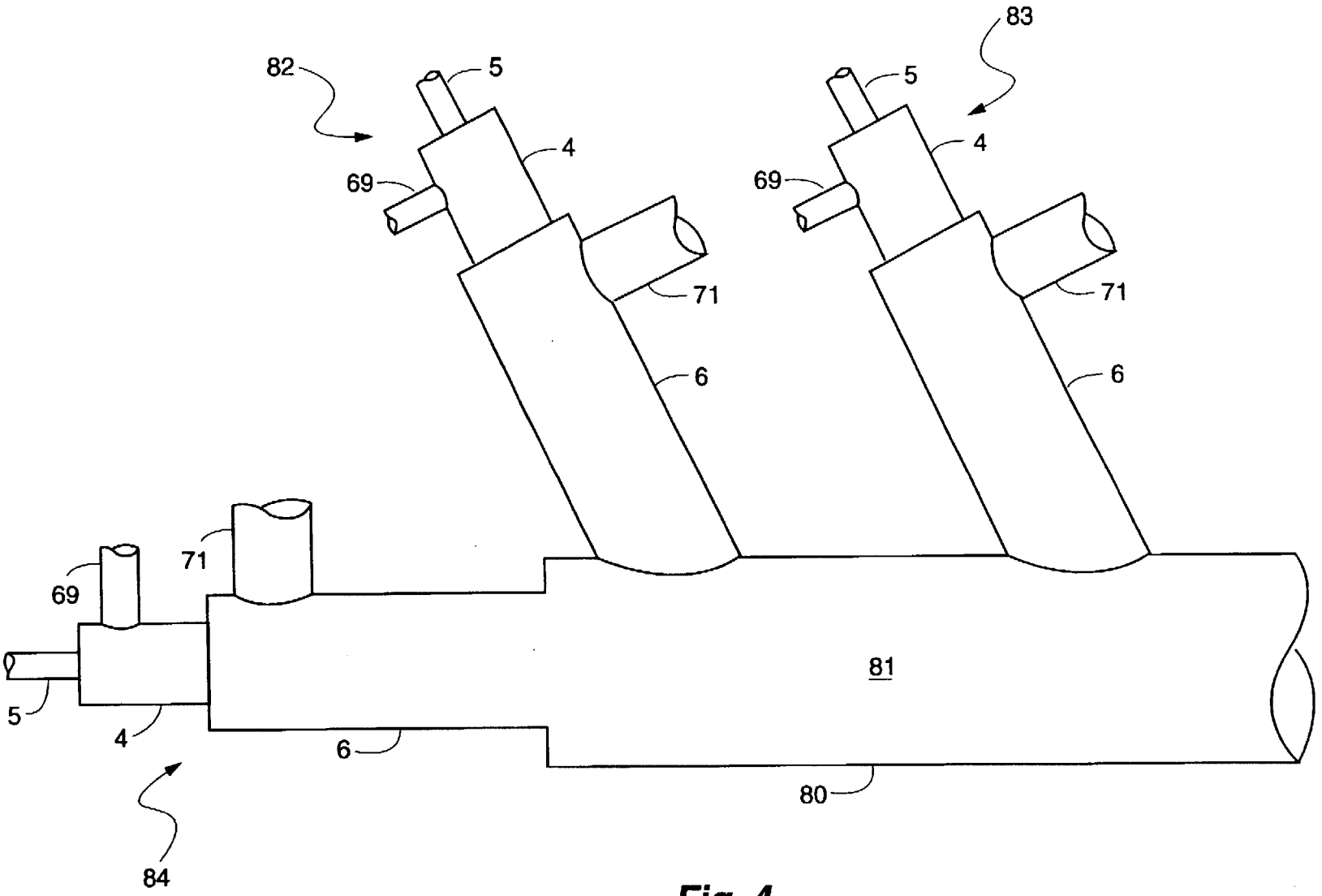
FIG. 4 depicts three steam generators arranged to provide steam to a common steam chamber.

FIG. 4 depicts a modular arrangement in which three steam generators 82, 83, and 84 are arranged to discharge steam into a common steam chamber 81, which is defined by steam conduit 80. A feed tube 5, feed conduit 4 and water conduit 6 are shown for each steam generator. Feed pipes 69 provide feed material to feed conduits 4. Water pipes 71 provide water to water conduits 6. FIG. 3 illustrates a different method of fabrication than that shown in FIG. 1. In FIG. 3, pipes 69 and 71 are joined with the feed conduits and water conduits at a right angle, whereas pipe bends are shown in the steam generator of FIG. 1. Steam conduit 80 supplies steam to a point or points of use. Multiple generators, or modules, feeding into a common steam chamber may be used to improve turn-down ratio and speed of response to changes in quantity of steam required by steam users. Also, use of a modular system will allow a system designer a significant amount of flexibility in specifying physical size and configuration of a steam generator installation to match each application.

It is expected that a single steam generator of this invention will operate efficiently at a reduced steam capacity of about 25% of its maximum design capacity, though a single generator should be capable of turn-down to about at least 10% of design capacity. The turndown ratio of a dry gas mixer of the type shown in FIG. 3 is 100%, that is, it will provide a fuel/air mixture of pre-set proportions at any flow rate between 0 and 100% of its rated flow. Use of multiple generators in one system will permit any desired turn-down ratio to be obtained while maintaining efficient operation. Steam usage changes may be accommodated by throttling fuel, air, and water flows to a single generator of a modular system in response to demand and, if demand increases to a pre-determined value, such as 95% of design capacity of an operating module, a second module is brought on line at the same time that output of the first module is reduced in order to maintain a constant output of steam. Alternatively, steam output may be varied by operating multiple generators in an on-off mode, where flows to each module are stopped and started by two-position valves which are either fully open or fully closed. In a variation of on-off control, modules may be maintained in an idling condition rather than completely off. During idling, relatively small flow rates of fuels and air are maintained and, depending on the application, water may or may not be provided to the combustion zone.

It is expected that an inventive steam generator will be capable of responding rapidly to changes in steam demand.

Water is supplied directly to the heat source; there is no need to transfer heat through a metal barrier to the water. Flows of fuel, air, and water can be increased and decreased as rapidly as the response time of the control system permits. In a modular system, maintaining generators in an idling mode will eliminate the time required to light-off modules, so that it is only necessary to increase flows to increase steam output. Response time of a system may be improved by use of several small generators instead of one large generator, where the flow rates to the small generators are adjusted simultaneously. Modules of different sizes may be used in a multiple generator system to facilitate operating at varying capacities.

The dimensions of a steam generator are established by reference to such parameters as required steam capacity, type of fuel, and the manner in which oxygen is to be supplied. Fuel, oxygen, and water flow rates are established by reference to the design steam capacity. The inside diameter of the feed tube, the cross-sectional area of the annular feed space, and the cross-sectioned area of the annular water space are then established using conventional methods. An exemplary steam generator configured as shown in FIG. 1 which is fabricated of Schedule 40 pipe and fittings which is designed to provide 220 pounds per hour of steam at about 45 psig will have a 2 inch water conduit, a 1½ inch feed conduit for air, and a ¼ inch feed tube for fuel (these pipe sizes are nominal, not actual, diameters). This example is based on the fuel being propane gas which is supplied to the inlet port at about 60 psig and aspiration of atmospheric air by means of a venturi on the feed tube. The venturi will have a throat diameter of about 0.10 inches, a diverging section length of about ⅜ inch, and an overall length of about 2½ inches. The length of the section of air conduit, measured along the common axis of the three Schedule 40 pipe sections, from the exit end of the venturi to the inlet end of the mixing zone weir is expected to be about 1½ inches. Generally, this length will range from about 1 to about 3 times the inside diameter of the air conduit. It is desirable to fabricate a prototype generator having a fuel feed tube passing into the air feed tube through a packing gland which permits movement of the fuel feed tube in an axial manner, thus permitting the length of the mixing zone to be varied in order to determine the minimum dimension required to achieve adequate mixing of fuel and air. The diameter of the outlet port of the mixing zone weir is about ¼ inch. Referring to both weirs, an angle of about 30 degrees is formed by the intersection of the axial centerline and a line representing an extension of the weir to the centerline. In the exemplary generator, the axial length from the outlet end of the mixing zone weir to the inlet end of the combustion zone weir is about 2 inches. The diameter of the outlet port of the combustion zone weir is about 5/16 inch. The axial length from the outlet end of the combustion zone weir to the outlet end of a secondary weir as shown in FIG. 1 is about 1½ inches. The diameter of the secondary weir outlet port will be about ⅜ inch and its angle to the centerline will be about 45 degrees. A prototype generator may be fabricated such that the length of the combustion zone may be varied, for purposes of experimentation. Of course, in such a prototype, a spark igniter configuration as shown in FIG. 1 cannot be used. Generally, the axial length from mixing zone weir outlet end to the outlet end of the combustion zone weir or, if secondary weirs are used, to the outlet end of the secondary weir which is furthest downstream will range from about 2 to about 5 times the diameter of the water conduit. Variations in flow velocity and pressure in the generator will substantially affect these lengths. For example, use of smaller diameter pipe will result in higher flow velocity and require greater distances between weirs. Those skilled in the art of fluid flow are capable of scaling up or scaling down the dimensions of the exemplary generator for different capacities and pressures or of determining appropriate dimensions without reference to the exemplary generator using well-known flow versus pressure drop data and methods of calculation.

Steam generators of this invention will be operated primarily with gaseous fuels, such as propane, natural gas, butane, and manufactured gas, but liquid fuels and coal slurries may also be used. The method of providing fuel to the generator depends on the application and the fuel which is selected. For example, a pump may be used to provide propane or liquid natural gas or the vapor pressure of the fuel may provide sufficient driving force. Oxygen for combustion will normally be supplied by atmospheric air, which may be aspirated into the mixing zone by use of gas pressure or provided by a blower. Air supplied by a blower may be used to aspirate fuel into the mixing zone, thereby facilitating production of high pressure steam. Either the feed tube or feed conduit may be used to supply fuel or oxygen. Of course, fuel delivery pressure must be greater than the steam pressure in order for fuel to flow into the generator. Commercially available burners or flame tips may be used.

It is expected that the thermal efficiency of inventive steam generators using gaseous fuel will be in the range of from about 95 to about 97%. Efficiency of modern prior art flash tube, or monotube, steam generation apparatus rarely exceeds 85% and that of multi-tube boilers is usually below 50%. High thermal efficiency is expected because combustion gases and excess air will be cooled to the temperature of the steam produced by virtue of mixing with the steam. Thus, flue gas heat losses are reduced. The invention does not use submerged combustion, where a burner is submerged in a reservoir of water and a flame is completely surrounded by water. Instead, a controlled amount of water is brought to a flame or combustion zone. Though the combustion zone of FIG. 1 is shown with a definite boundary and that boundary can be visualized as a flame envelope, the combustion zone of a steam generator is not limited to such a boundary. The flame may be non-coherent and combustion may take place outside the boundary depicted, such as in the space between the combustion zone weir and the mixing zone weir and between the combustion zone weir and the secondary weir. The combustion zone is defined as the location where fuel is burned.

The design of the inventive steam generator is such that emissions of nitrogen oxides, hydrocarbons, and carbon monoxide are expected to be relatively low. Further, if the application permits, operating conditions may be adjusted so that such emissions will be virtually non-existent. Combustion zone temperatures will be low and hot spots are not expected to occur, thus minimizing formation of nitrogen oxides. Carbon monoxide and hydrocarbon emissions will be minimized because cold spots are not expected to occur in the combustion zone and conditions in the generator will favor the reaction of carbon monoxide and oxygen to form carbon dioxide.

Nitrogen begins to combine with oxygen to form nitrogen oxides at about 1040° F. The inventive process may be controlled so that the maximum temperature at any location in the combustion zone does not exceed about 1000° F. A normal combustion zone operating temperature of about 800° F. is expected to provide steam at a pressure suitable for most applications, including vehicle propulsion. Because water is fed directly into the flame, it is not necessary to produce high temperatures to move heat across a barrier into water. The response of combustion zone temperature to changes in water flow is rapid, due to the lack of such barrier, allowing precise control of combustion zone temperature. The portions of the steam generator which would be at the highest temperatures in the absence of water flow are cooled by the incoming feed water. Water flowing into the combustion zone from the annular water space cools the outer surface of mixing zone weir 8 and the inner surface of combustion zone weir 10 (FIG. 1). Referring to FIG. 3, mixture weir 116 and combustion zone weir 10 are cooled by incoming water before it is vaporized. Carbon monoxide formation and incomplete combustion can be controlled by precise control of fuel/air ratio. Combustion zone temperature also influences the quantity of CO which is formed. This external combustion process can be controlled more precisely than internal combustion so that undesirable emissions are minimal in comparison to those of an internal combustion engine. Complete combustion of a pure fuel will result in formation of water and carbon dioxide, with no carbon monoxide or unburned carbon.

Conventional corrosion and scale control additives may be used as required to control substances such as magnesium, calcium, chlorides, iron, manganese, and silicon. Generally, additives will not be required in a closed loop system, but may be needed in a once-through system in which the steam is vented to atmosphere after use. Since the water formed by combustion forms a part of the steam produced by a generator, make-up water required in a closed system of generator and users is reduced and, in a substantially leak-free system, it may be necessary to bleed excess water from the system. About 2 pounds of water is formed from combustion of one pound of propane or natural gas. Because of the relatively small size of the inventive generators, it is feasible to construct them of non-corroding metals, such as stainless steels. An advantage of the inventive generators is that they may be easily fabricated using standard pipe and fittings, including threaded fittings. Use of threaded fittings will minimize welding.

A fuel-air mixture may be ignited by a device which produces sparks by means of establishing a voltage difference between electrodes separated by a gap or by other conventional methods. It may be desirable to operate a sparking igniter continuously rather than actuating it intermittently when needed to ignite the mixture. A conventional flame sensing device (not shown in the drawings) must be used to actuate means for stopping flow of fuel to a generator when combustion ceases for any reason. Other safety devices which may be required for a particular application, such as steam pressure safety valves, are well-known.

In some applications, it may be desirable to recirculate steam from the outlet of a generator (or steam chamber) to the water inlet of the generator. Also, it may be desirable to provide a water jacket on a portion of the exterior of a generator to preheat feed water; feed water would pass through the jacket before entering the water conduit. Placement of screens or gratings at the outlet ends of the weirs will promote mixing. In particular, a screen at the combustion zone weir will break up any drops of water which might be in the stream passing out of the combustion zone. Whether a steam chamber for receiving steam from a generator is used depends on the application, as does the size of the steam chamber. The conduits of the invention need not be circular in cross-section, but may have a square or other cross-section geometry. Degrees F is denoted herein by "F".

What is claimed is:

1. Apparatus for generation of steam comprised of:

a. a feed tube having a fluid entry port at a first end and having a second end;

b. a feed conduit having a fluid entry port at a first end and having a diameter greater than the diameter of said feed tube, where said feed conduit is disposed concentrically with the feed tube to form an annular feed space;

c. a mixing zone weir having an inlet port and having an inlet end attached to and communicating with a second end of the feed conduit;

d. a mixing zone located within the feed conduit which communicates with the feed tube at a second end of the feed tube, with said annular feed space, and with said mixing zone weir inlet port;

e. a water conduit having a water entry port at a first end and having a diameter greater than the diameter of the feed conduit, where said water conduit is disposed concentrically with the feed conduit to form an annular water space;

f. a combustion zone weir having an inlet end attached to and communicating with a second end of the water conduit;

g. a combustion zone which is comprised of space between the mixing zone weir and said combustion zone weir, where said combustion zone is in communication with said mixing zone;

h. a water distribution zone which communicates with said annular water space and is bounded by the mixing zone weir, the combustion zone weir, the water conduit, and the combustion zone, such that water which flows into said water distribution zone from said annular water space flows into the combustion zone; and i. ignition means for establishing combustion in the combustion zone.

2. The apparatus of claim 1 further including a steam chamber in communication with the combustion zone.

3. The apparatus of claim 1 further including means for separating incondensable gases from steam which is produced.

4. The apparatus of claim 1 further including means for separating liquid water from steam which is produced.

5. The apparatus of claim 1 further including means for mixing a fluid flowing out of the second end of the feed tube with a fluid flowing out of the second end of the feed conduit.

6. The apparatus of claim 5 where said mixing means is a venturi.

7. The apparatus of claim 1 further including a venturi which communicates with the feed tube, said venturi having an inlet end attached to the second end of the feed tube.

8. The apparatus of claim 1 further including a secondary weir housing and one or more secondary weirs, where both the secondary weir housing and the secondary weirs are disposed concentrically with the combustion zone weir and downstream of the combustion zone weir.

9. The apparatus of claim 1 further including means to prevent backflow of fluids in the feed tube, feed conduit, and water conduit.

10. Apparatus for generation of steam comprised of:

a. a mixture feed conduit having a fluid entry port at a first end;

b. a mixture weir having an inlet end attached to and communicating with a second end of said mixture feed conduit;

c. a water feed conduit having a water entry port at a first end and having a diameter greater than the diameter of the mixture feed conduit, where said water conduit is disposed concentrically with the mixture feed conduit to form an annular water space;

d. a combustion zone weir having an inlet end attached to and communicating with a second end of the water conduit;

e. a combustion zone which is comprised of space between the mixture weir and said combustion zone weir, where said combustion zone is in communication with said mixture feed conduit;

f. a water distribution zone which communicates with said annular water space and is bounded by the mixture weir, the combustion zone weir, the water conduit, and the combustion zone, such that water which flows into said water distribution zone from said annular water space flows into the combustion zone; and g. ignition means for establishing combustion in the combustion zone.

11. The apparatus of claim 10 further including means for mixing fuel and air which is supplied to the mixture feed conduit.

12. The apparatus of claim 10 further including a dry gas mixer comprised of a mixing chamber for mixing of air and fuel, means for varying rate of flow of air into said mixing chamber, and means for varying rate of flow of fuel into the mixing chamber in such manner as to maintain a previously established ratio between air flow and fuel flow.

13. The apparatus of claim 10 further including a steam chamber in communication with the combustion zone.

14. The apparatus of claim 10 further including means for separating incondensable gases from steam which is produced.

15. The apparatus of claim 10 further including means for separating liquid water from steam which is produced.

16. The apparatus of claim 10 further including a secondary weir housing and one or more secondary weirs, where both the secondary weir housing and the secondary weirs are disposed concentrically with the combustion zone weir and downstream of the combustion zone weir.

17. The apparatus of claim 10 further including means to prevent backflow of fluids in said feed conduits.

18. A method of generating steam comprising:

a. mixing fuel and oxygen in a mixing zone to form a mixture and flowing said mixture into a combustion zone;

b. combusting the mixture in said combustion zone to form a heat source;

C. flowing water into the combustion zone and limiting water flow rate to a value less than that which will quench combustion of the mixture;

d. controlling the quantity of mixture flowing into the combustion zone at a value which is required to produce at least sufficient heat to vaporize substantially all water flowing into the combustion zone; and e. configuring the combustion zone so that substantially all water flowing into it is exposed to said heat source for a time sufficient for vaporization of the water to take place.

19. The method of claim 18 where the temperature at any location in the combustion zone is maintained at about 1000 ° F. or less.

20. The method of claim 18 where the ratio of fuel to oxygen in said mixture is maintained at a value sufficient to provide substantially complete combustion of the fuel to water and carbon dioxide.

* * * * *